United States Patent [19]

Sines et al.

[11] Patent Number: 4,930,782

[45] Date of Patent: Jun. 5, 1990

[54] STRING TENSION TRANSMITTING APPARATUS

[75] Inventors: Randy D. Sines, Klamath Falls, Oreg.; Bruce W. Farber, Oakview, Calif.

[73] Assignee: Karakal Corp. of the Americas, Ventura, Calif.

[21] Appl. No.: 356,988

[22] Filed: May 24, 1989

Related U.S. Application Data

[63] Continuation of Ser. No. 54,429, May 26, 1987, abandoned.

[51] Int. Cl.[5] ..... A63B 49/00

[52] U.S. Cl. ..... 273/73 D

[58] Field of Search ..... 273/73 A, 73 B, 73 C, 273/73 D, 73 E, 73 R, 73 G, 73 H, 73 K, 73 L

[56] References Cited

U.S. PATENT DOCUMENTS

| | | | |
|---|---|---|---|
| 1,470,878 | 10/1923 | Robinson . | |
| 1,523,865 | 1/1925 | Craig . | |
| 1,559,986 | 11/1925 | Quick . | |
| 2,145,785 | 1/1939 | Aubert . | |
| 2,456,023 | 12/1948 | Rosenbalm . | |
| 3,884,467 | 5/1975 | Sommer . | |
| 3,999,756 | 12/1976 | Head . | |
| 4,118,029 | 10/1978 | Septier . | |
| 4,185,822 | 1/1980 | Li . | |
| 4,203,597 | 5/1980 | Reedhead et al. . | |
| 4,441,712 | 4/1984 | Guthke . | |
| 4,462,592 | 7/1984 | Legger et al. . | |
| 4,595,201 | 6/1986 | Fisher | 273/73 D |
| 4,681,319 | 7/1987 | Zilinskas | 273/73 D |

FOREIGN PATENT DOCUMENTS

| | | |
|---|---|---|
| 873589 | 3/1942 | France . |
| 4365 | of 1914 | United Kingdom . |
| 262638 | 12/1926 | United Kingdom . |
| 309238 | 4/1929 | United Kingdom . |

*Primary Examiner*—Edward M. Coven
*Assistant Examiner*—William E. Stoll
*Attorney, Agent, or Firm*—Wells, St. John & Roberts

[57] ABSTRACT

A string tension transmitting device positionable against an outwardly facing head frame surface of a stringed sports racket. The tension transmitting devices receive and support the racket string thereover. The devices are adapted to the head frame surface to form a rocking relation therewith. Relatively greater tension in one string chord can be transmitted through the tension transmitting device to an associated string chord. Such transmission of tension allows strain energy to be stored in several string chords in addition to chords directly contacted by the ball or other impacting object. This results in a larger overall deflection of the string face of the racket and a lower peak dynamic string tension. The tension transmitting device includes rocker members that can be received between the string and racket head as it wraps over the outer racket head surface. The rockers receive the string along string receiving surfaces such as grooves formed in top surfaces of the rocker members. Opposite the string receiving surfaces are rocker surfaces that provide for relatively friction-free rocking engagement against the outer surface of the racket head frame. Also disclosed are rackets adapted with the string tension transmitting devices.

44 Claims, 6 Drawing Sheets

FIG 7
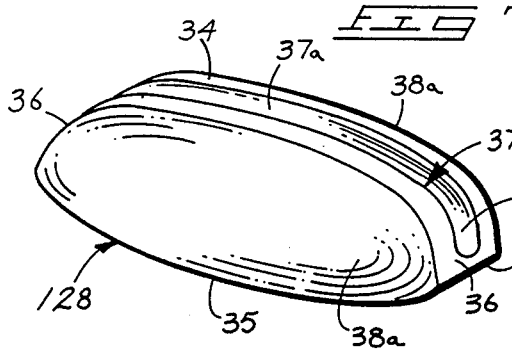
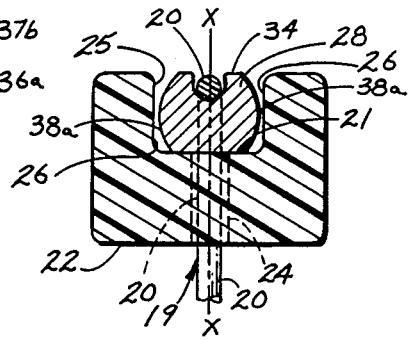
FIG 8
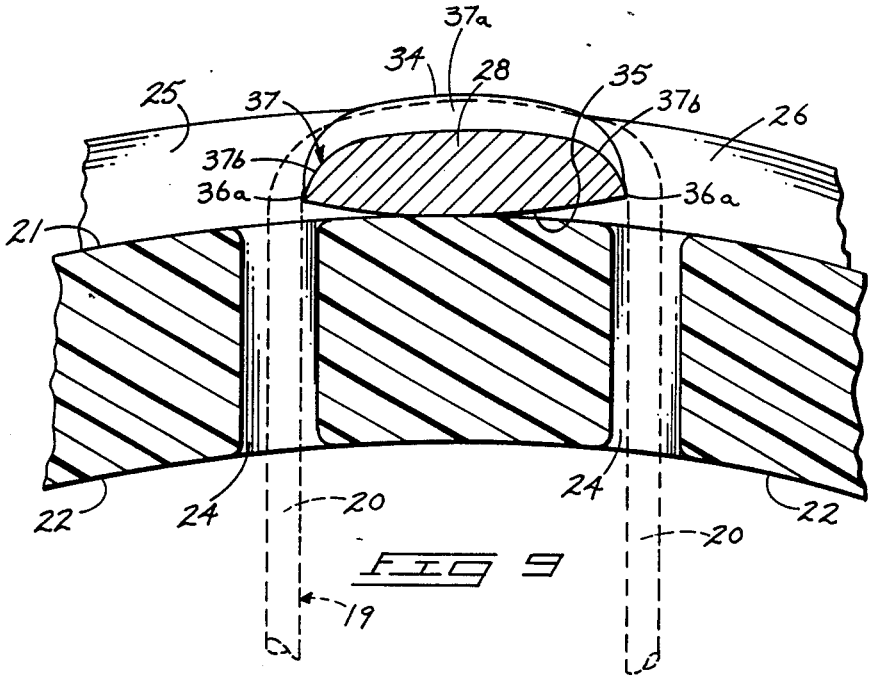
FIG 9

725
728
725
728
721
735
735
718
720
717
710
721
21
725

741
720
740
740
741
728

STRING TENSION TRANSMITTING APPARATUS

RELATED APPLICATIONS

This is a continuation of application Ser. No. 054,429, filed May 26, 1987, now abandoned.

FIELD OF THE INVENTION

The present invention relates to transmission of tension among the various strings of a strung sports racket upon impact with a ball or other playing object.

BACKGROUND OF THE INVENTION

Most conventional sports rackets have strings which are effectively anchored as they pass through string holes and about the frame of the racket. The isolation of each string chords causes localized high dynamic string tension to be developed in the chords which are actually struck by a ball or other object. The dynamic string tension, static string tension, string elasticity, frame stiffness, strung area geometry, and racket balance are all factors known to affect power, control, comfort and equipment performance. Many racket shapes, sizes, materials, string tensions, weights, even grips have been tried to improve racket performance.

U.S. Pat. No. 3,999,756 to Head teaches an enlarged string area for tennis rackets to enhance physical properties such as the location of the center of percussion and the magnitude of the polar moment of inertia. The Head racket is shown with each string chord being a different length than its neighbor. Each string chord is effectively anchored at opposite ends as it bends over a resilient pad on the frame and extends to the next adjacent hole. The anchored string relationship causes high dynamic tension along individual string chords during impact with resulting problems of string and racket breakage, sensitivity to weather, and wear.

U.S. Pat. No. 1,559,986 to Quick and U.S. Pat. No. 4,462,592 to Legger et al. exemplify spring devices for mounting tennis racket strings. They make use of various pulley or guide arrangements mounting the string chords with springs. The springs function as reaction members with responses varying depending upon the spring's resistance to compression or extension. These patents are also illustrative of slides or sheave arrangements guiding the string courses across the racket face. While sheaves have some effect on transmission of tension from one string chord to the next, the transmission of tension is limited by the resilient action of the spring which tends to minimize tension.

The 1942 French patent to Lemoine discloses another form of spring mechanism between adjacent string chords in a tennis racket head. In one form, the spring is formed of a wire band for yieldably receiving the string. In another form, a wire spring-action band mounts a pulley or sheave for receiving the string. In yet another form, Lemoine uses both a spring band and an elastic material partially enclosed by the band. In the later form, the springs are positioned within recesses in the racket head frame with ends of the springs abutting walls of the recesses. Rocking movement of the springs is prevented by the walls of the recesses. The Lemoine spring members do not rock in response to differential tension in adjacent string chords. Instead, the Lemoine devices respond to the force existing in one chord and limit the tension by resilient deformation of the spring member.

Further spring mechanisms mounted between adjacent string chords on a tennis racket head are disclosed in British Patent309,238 granted in 1928 to Brooks and in U.S. Pat. No. 1,523,865 to Craig. These patents disclose several spring configurations by which tennis racket string chords may be resiliently mounted to a racket head. The springs do not rock in any manner to transmit tension, but instead deflect in response to applied tension.

A 1914 British patent to Lidy discloses a tennis racket having a string tension adjusting mechanism. The arrangement incorporates a hollow head frame in which a series of substantially spherical rollers are situated to receive the various string chords. The rollers are claimed to even tension over the racket surface during tension adjusting operations. However, rollers respond to uneven string tension by rolling along the racket head in the direction of the tension. This results in mislocated strings.

U.S. Pat. No. 4,441,712 to Horst Guthke illustrates a tennis racket string mount. Strings are connected to the racket frame through a number of linking elements that permit displacement of the string connection points relative to the racket head frame. A complex linkage and pin arrangement is used to eliminate asymmetrical deflection of the strings in the area adjacent the head frame. The linkages are used to essentially change the anchor point of the various strings in relation to the racket head frame. The result claimed is establishment of the advantages of a large racket head in a conventional size head frame. However, the string connections extend into the string opening of the racket shortening the string chord lengths. Reduced string length reduces the available dynamic strain or elongation which the string chords can produce. Furthermore, the various pivots reduce efficiency due to friction. The Guthke invention further includes pulleys or sheaves within the racket face which support a single strand of string arranged through the pulleys. The pulleys further extend into the string opening shortening the overall string length and decreasing the opening size. The pulley and link arrangements add significantly to the head weight of the racket. Other pulley arrangements are shown in U.S. Pat. No. 2,145,785 to Aubert, and in U.S. Pat. No. 4,203,597 to Reedhead.

There remains a need for optimizing power and control of a stringed racket while minimizing the complexity of mechanisms for achieving such results. It is also desirable to incorporate simple, effective, features in a stringed racket that will produce a higher coefficient of restitution thus providing increased power for the same exertion. Rackets which display lower stress in the racket frame during the hit are also desired because of the lower magnitude of vibrations experienced by the player. It is also desirable to lower the peak tension in the strings during the hit and to balance restoring forces. Restoring forces can be balanced by providing even dynamic string tension as seen by the hit object, preferably approaching that of a uniform membrane. Such uniformity reduces edge effects on off-center hits. It is additionally desirable to provide a longer dwell time for better control and larger string deflection for better energy transfer and additional power return to the ball.

BRIEF DESCRIPTION OF THE DRAWINGS

Preferred forms of the present invention are shown in the accompanying drawings in which:

FIG. 7 is a perspective view of an alternative rocker having convex sidewalls;

FIG. 8 is a transverse sectional view showing the rocker of FIG. 7 mounted to a racket head;

FIG. 9 is an enlarged longitudinal sectional view of a mounted rocker, sectioned along a plane passing through the string receiving groove thereof with the string shown in phantom;

DETAILED DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

The present invention can be incorporated into any size of sports racket made from any suitable material. Rackets having a variety of geometries can be provided or fitted with the invention. For purposes of this application, an exemplary configuration is that of a mid-sized tennis racket, which may be made from graphite fiber impregnated resin.

Figure 1:
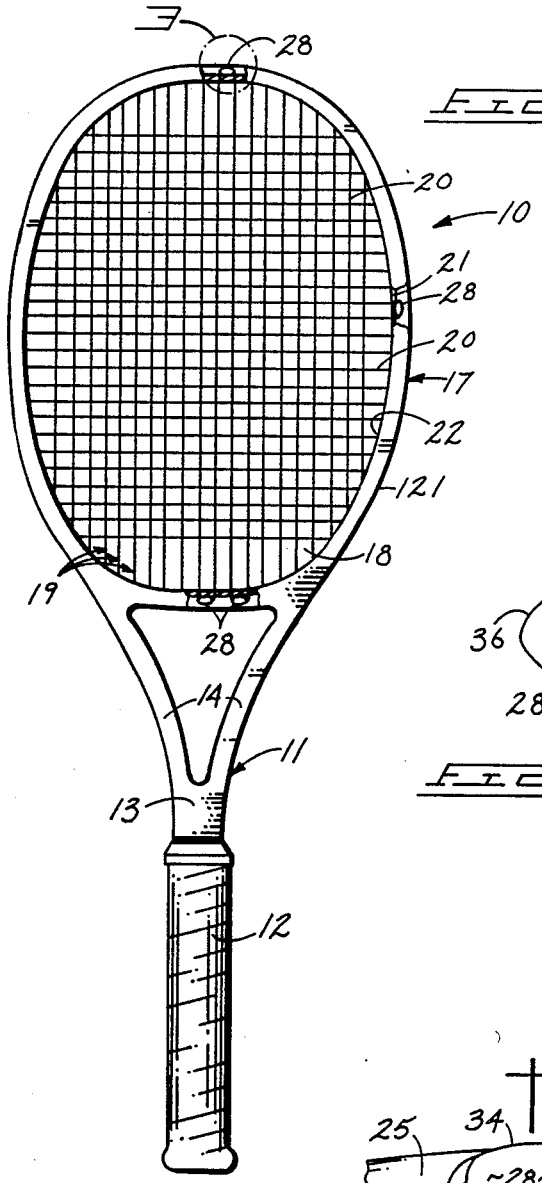
FIG. 1 is a view of a tennis racket with portions broken away and shown in section to illustrate features of the invention.

An exemplary racket is shown at 10 in FIG. 1 of the drawings. Racket 10 includes an elongated handle 11 extending from a handgrip 12 along a shaft 13 to a throat 14. The throat 14 is secured or integral with a head frame 17.

Head frame 17 is planar with handle 11. Head frame 17 surrounds and defines a string opening 18. A string or strings 19 may be threaded through head frame 17 in a woven or criss-cross fashion of individual string chords 20. The woven string pattern defines planar racket faces for impact with a ball or other playing object. Conventional sports racket strings made from a single strand of gut or synthetic string material are appropriately used with the invention. The ends of the strings can be secured to the head frame in any appropriate manner, well-known in the art.

The head frame of racket 10 includes a curved perimeter surface 121 that is oriented perpendicularly to the planar racket opening. An inner surface 22 of head frame 17 defines the configuration of string opening 18.

Head frame 17 is also preferably provided with an annular channel 25 extending about its outer periphery. The base or bottom surface of channel 25 forms an outwardly facing head frame surface 21 for purposes of this description. Outwardly facing surface 21 is situated between channel walls 26. Surface 21 can be convex as shown at the top and side of racket 10 or flat as shown in FIG. 1 at the bottom of the racket head frame, adjacent throat 14.

String 19 is threaded through head frame 17 using string holes 24. String holes 24 are preferably arranged to be coaxial with the strings passing through them. The string holes 24 are arranged in two groups. A first, longitudinal group of string holes 24 may be formed through the racket head frame along parallel longitudinal axes and spaced across the head frame to receive portions of the longitudinal string chords. A second or transverse group of string holes may be formed up the sides of the head frame between surfaces 21 and 22. The holes of the second group are preferably parallel to one another and spaced along the head frame in transverse orientation to the longitudinal string chords.

String holes 24 are preferably of sufficient size to loosely receive string chords 20. Segments of string chords 20 are advantageously centered within the holes without touching or rubbing against the walls of holes 24 between the outer and inner surfaces 21 and 22. The string chords 20 are not anchored in holes 24. Anti-friction guides or sleeves (not shown) can also be used in string holes 24.

The present invention includes a tension transmitting device advantageously in the form of individual rockers 28 as shown in FIGS. 2 through 9. Rockers 28 transmit tension from one string chord to an associated string chord. Such associated string chords are typically arranged through two adjacent string holes, although other arrangements are possible. String tension transmission is accomplished by rocking action of rockers 28.

Figure 2:
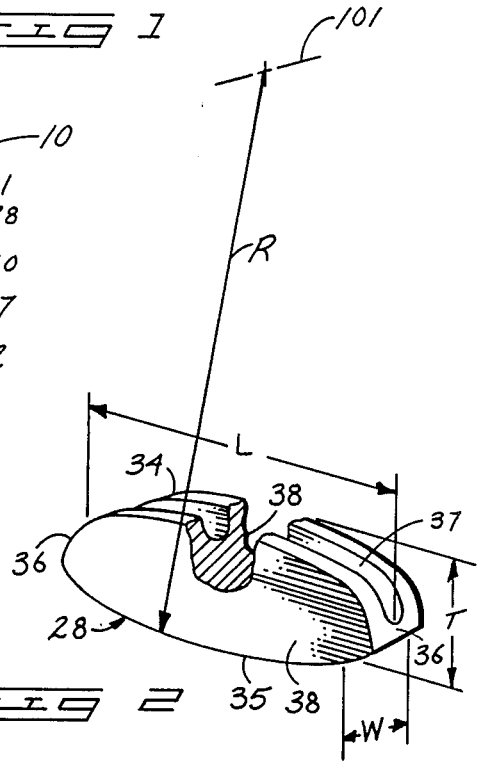
FIG. 2 is a pictorial view of a rocker device with a portion thereof broken away and shown in section.

A first embodiment rocker 28 is shown in detail in FIGS. 2–6 and 9. An alternative rocker 128 is shown in FIGS. 7 and 8. Rockers 28 and 128 each include a top side 34 and bottom side 35. Top and bottom sides 34 and 35 preferably extend arcuately between ends 36. The top 34, bottom 35 and ends 36 are joined by side faces or sidewalls 38. FIG. 2 shows several dimensions for rocker 28. The distance between extremes of top side 34 and bottom side 35 will be considered the thickness dimension "T" of the rockers. The distance between side faces 38 is considered the width dimension "W".

The distance between ends 36 is the length dimension "L".

It is preferred that the rockers be elongated, with the length dimension "L" being greater than the thickness "T". More preferably the length dimension "L" is more than twice the thickness "T". This provides a low rocker profile which reduces the overall thickness of the racket head frame 17.

The lengths L of the individual rockers are preferably such that string chords arranged over the top surfaces 34 and ends 36 can be approximately centered within the string holes 24. Contact is preferably made between the string and the racket frame only by way of rockers 28. This structure eliminates frictional contact between the string chords and the head frame.

The actual length dimension L between rocker ends 36 may be equal to but is preferably slightly less than the distance between centers of adjacent parallel string holes 24. The length dimensions are advantageously equal to the distance between adjacent string hole axes, less the diameter of the string being used.

A string receiving surface is preferably provided along each rocker. The string receiving surface is advantageously comprised of a groove 37 extending in a plane X—X (FIGS. 4 and 8) that passes longitudinally through or over the rocker body. Groove 37 is preferably formed into the top surface 34 to a depth allowing the string to be fully received therein with the top edges of the rocker projecting slightly beyond the string as shown in FIGS. 3–6 and 9. The top side of the rocker may therefore protect the string against abrasion during use of the racket.

The string receiving groove 37 is preferably formed as a longitudinal arc extending between ends 36 (see FIG. 9). The longitudinal arc advantageously includes a medial portion 37*a* which has a relatively low curvature compared to groove end portions 37*b*. Groove end portions 37*b* have a relatively greater curvature which allows the string chord to separate from the rocker in an approximately tangential relationship at rocker tip ends 36*a*. Rocker ends 36 can alternatively be formed with a smooth curvature extending over ends 36. The tangential separation of string chords 20 from rocker 28 minimizes wear, reduces friction and prevents localized pinching or stress from prematurely wearing the string. The elongated shape of rocker 28 and the three portion arcuate receiving groove 37 minimizes bending stress on the string while providing for good maintenance of string chord alignment with holes 24.

String receiving groove 37 is preferably formed in a concave cross-sectional shape adapted to receive string 19 therein. The cross-sectional size of groove 37 can be slightly larger than the diametrical size of the string to allow easy insertion.

The invention includes a rocker means which allows rocker member 28 to rock in response to different amounts of force applied by the associated string chords 20. The rocker means is preferably provided by forming bottom surface 35 of rocker 28 into a convex shape. The convex rocker surface 35 preferably has an approximately uniform longitudinal shape across the rocker between sidewalls 38.

Rocker surface 35 may advantageously be formed as a portion of a cylindrical surface having a cylindrical axis 101 (FIG. 2) which is approximately perpendicular to longitudinal plane X—X (FIG. 4) of rocker member 28. FIG. 2 shows that rocker surface 35 may further be defined by a cylindrical radius R swung in a longitudinal plane parallel to the central longitudinal plane X—X. The radius R is preferably greater than one half the rocker length L. Radius R is more preferably approximately three times the length L. It is alternatively possible to have noncylindrical convex rocker surfaces which provide rocking action against the outwardly facing racket surface 21.

Rockers 28 are preferably received against outwardly facing surface 21 with the axes of curvature of the rocking surfaces 35 approximately perpendicular to the planar string opening 18. Each cylindrically convex rocker surface 35 contacts racket surface 21 along a line of contact which moves with rocking motion of rockers 28. The moving or movable line of contact exists at the line of tangency between the rocker surface 35 and the racket surface 21. Rockers 28 are advantageously oriented with the axes of curvature of rocking surfaces 35 perpendicular to the string opening. In such a configuration the lines of contact will also be substantially perpendicular to the plane of the string opening.

Figure 3:
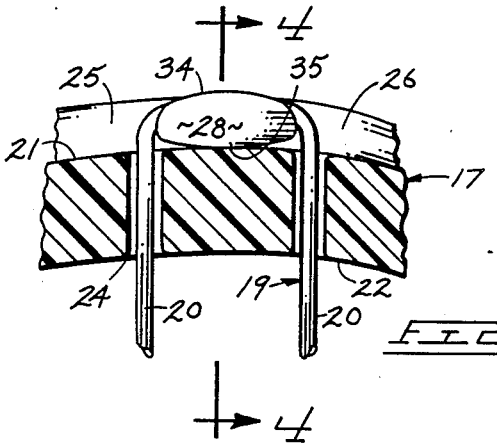
FIG. 3 is a sectional view enlarged from the circle numbered 3 in FIG. 1 showing a rocker mounted to a racket head; the rocker is shown in an equilibrium position associated with equal tension in the two associated string chords.
Figure 5:
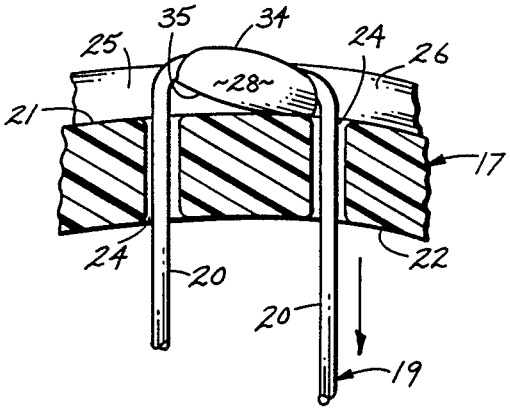
FIGS. 5 and 6 are views similar to FIG. 3 showing the rocker in exaggerated non-equilibrium positions associated with differing tensions in the string chords.
Figure 6:
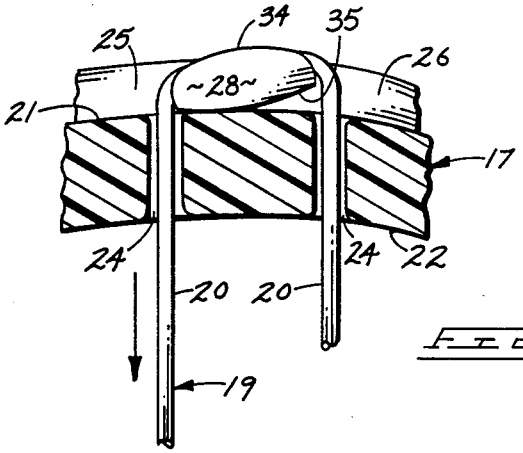

The curve of rocker surface 35 is such that its rocking action will not result in significant movement of the string chords within string holes 24. The limited movement is illustrated by FIGS. 3, 5 and 6. FIG. 3 shows rocker 28 in an equilibrium position. FIGS. 5 and 6 show rocker 28 displaced an exaggerated amount in response to different amounts of force applied by associated string chords 20. The amount of rocking displacement will in most cases be relatively smaller than that shown in FIGS. 5 and 6 because of the very small changes in string length needed to equalize the forces in associated string chords. The related trigonometric change in the position of rocker ends 36 will accordingly be very small, thus preventing or minimizing contact between string chords 20 and string holes 24.

An example indicating acceptable dimensions for rockers 28 used in a racket having typical string hole spacings of approximately one-half inch (12.7 millimeters) will now be given. A preferred rocker length dimension L is approximately 29/64 inches (11.5 millimeters). The preferred thickness dimension T is approximately 3/16 inches (4.8 millimeters). The preferred radius of curvature for the bottom rocker surface 35 is approximately three times the length dimension L or approximately 1-5/8 inches (35.9 millimeters).

The string hole spacing from one racket to another may be fairly consistent or may vary. Dimensions given herein for a preferred rocker may also be varied to accommodate the particular racket and string hole spacing.

Figure 4:
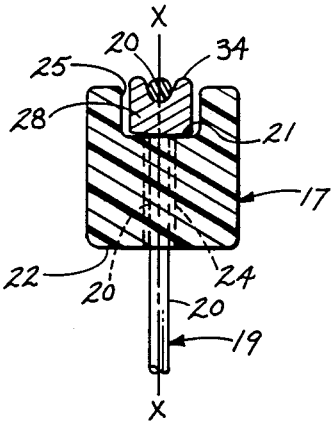
FIG. 4 is a sectional view taken substantially along 4—4 in FIG. 3.
Figure 4A:
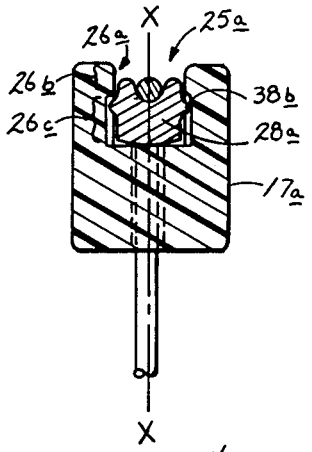
FIG. 4A is a sectional view similar to FIG. 4 of an alternative frame and rocker structure according to this invention.

FIG. 4A shows an alternative cross-sectional construction which may be used with rackets according to this invention. A racket head frame 17*a* is provided with a channel 25*a* which has sidewalls 26*a*. Sidewalls 26*a* have an outer portion 26*b* and an inner portion 26*c*. The opposing outer portions are spaced more closely together than the inner portions 26*c*. Such channel is designed to receive a rocker 28*a* having side projections 38*b* which are shaped as a small button or tit. The projections can be sized to snap into the channel and are loosely received between the inner portion sidewalls 26*c*. The racket head can also be constructed to allow the projections to be inserted at a specific opening into the channel rather than snap installation. The projections do not affect the rocking action during normal operation but serve to prevent loss of the rockers when the string breaks.

FIGS. 7 and 8 show an alternative rocker 128 according to this invention. Rocker 128 is substantially the same as rocker 28 described above. Rocker 128 differs from rocker 28 solely with regard to the convex shape of sidewalls 38*a*. The convex sidewall shape allows the rocker to contact the interior channel walls 26 of the racket at a point of contact rather than over the entire sidewall. This feature helps to reduce friction between rocker 128 and the racket in the event the rocker becomes displaced within channel 25 during play. Convex sidewalls or side surfaces conceptually similar to sidewalls 38*a* can be used in other embodiments of this invention.

Figure 10:
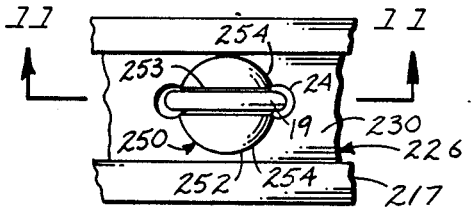
FIG. 10 is a partial plan view looking into a groove in a tennis racket frame fitted with an alternative embodiment rocker structure of this invention.
Figure 11:
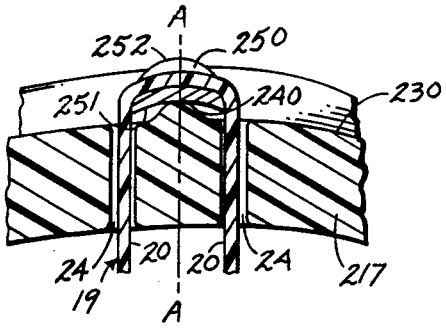
FIG. 11 is a sectional view taken along line 11—11 of FIG. 10.

FIGS. 10 and 11 show a further alternative embodiment rocker system according to this invention. A rocker body 250 is mounted for rocking motion within a channel 226 of a racket head frame 217. Racket head frame 217 is specially adapted with a projection or bump 240 which extends outwardly from the outwardly facing bottom surface 230 of channel 226. Projection 240 is preferably symmetrical about a central axis A—A perpendicular to surface 230. The central axis A—A is preferably parallel to the adjacent string hole axes and centered therebetween. Projection 240 is also preferably formed with a smoothly convex surface at the distal or top portion of the projection. The distal portions of projection 240 are preferably portions of a hemisphere or some other suitable shape. The projection 240 may be integral with the racket head or may be attached appropriately between adjacent string holes 24 to the racket surface 230.

The distal portion of projection 240 engages rocker 250 at a bottom surface 251. Bottom surface 251 is concave and forms a pocket, preferably a portion of a hemisphere, with a radius of curvature which is significantly longer than a radius of curvature defining the distal portions of projection 240. This relationship and the interengagement of projection 240 with bottom surface 251 allows rocking motion of rocker 250. Contact between the pocket of bottom surface 251 and projection 240 theoretically occurs at approximately a point contact which moves as a result of rocking motion of rocker 250.

Rocker 250 also has an upper or top surface 252 which can advantageously be made in the general shape of a hemisphere. Top surface 252 is provided with a recessed groove 253 which is adapted to receive string 19 thereover. String groove 253 is longitudinally profiled in a smooth curve to minimize bending stress in string 19. Rocker 250 is sized to properly position string chords 20 within string holes 24. Sides 254 of the rocker 250 may be rounded to provide point contact with the side walls of groove 226 to minimize frictional contact with the sidewalls should the rocker be displaced against either of them.

Figure 12:
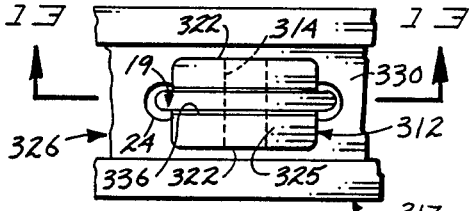
FIG. 12 is a partial plan view similar to FIG. 10 fitted with a further alternative rocker.
Figure 13:
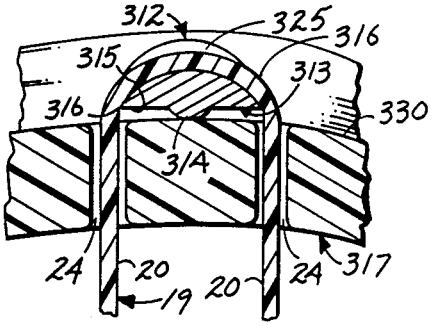
FIG. 13 is a sectional view taken along line 13—13 of FIG. 12.

FIGS. 12 and 13 show another alternative embodiment rocker system of this invention. A rocker member 312 is mounted to support string 19 in rockable relation to a racket head frame 317. Head frame 317 has a channel 326 with an outwardly facing bottom surface 330. Surface 330 can be flat or convex as shown in FIG. 13. Surface 330 is preferably not provided with a projection.

Rocker 312 has a bottom surface 313 which is provided with a transverse projection 314. Projection 314 preferably extends across the rocker member between sidewalls 322 using a uniform longitudinal profile. Projection 314 is convex and can advantageously be semicylindrical.

Bottom surface 313 also includes end portions 315 extending from projection 314 to end points 316 at opposite ends of rocker 312. End portions 315 are flat and spaced from outwardly facing racket surface 330 during normal operation to allow freedom for rocker 312 to rock upon the channel bottom surface 330. The projection 314 contacts the racket surface 330 along a movable line of rocking contact that will be substantially perpendicular to the plane of the string opening 18. The line of contact moves as the rocker rocks in response to different amounts of force applied by the associated string chords 20.

Rocker 312 also include a top surface 325 which is advantageously a portion of a cylindrical surface. Top surface 325 further includes a string-receiving surface or groove 336 which is recessed and adapted to receive string 19 therein. String receiving groove 336 is provided with a smooth longitudinal profile to minimize bending stress on the string as it passes over rocker member 312. The transverse shape of groove 336 is advantageously semicircular and slightly larger than the diametrical size of string 19.

Figure 14:
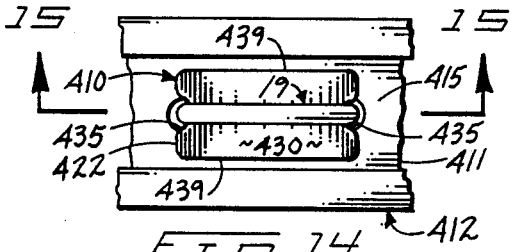
FIG. 14 is a partial plan view similar to FIG. 10 fitted with a still further alternative rocker.
Figure 15:
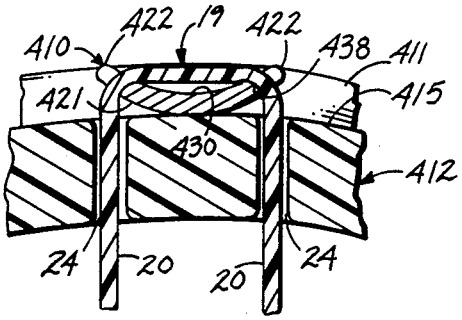
FIG. 15 is a sectional view taken along line 15—15 of FIG. 14.

FIGS. 14 and 15 show a further alternative embodiment rocker system of this invention. The embodiment includes a rocker 410 which is adapted and mounted for rocking motion within a channel 411 formed in a racket head 412. Channel 411 has an outwardly facing racket surface 415.

Rocker 410 has a convex bottom surface 421 which extends between opposing ends 422. Bottom surface 421 bears against the flat or convex outwardly facing racket surface 415 to provide a means for rockably transferring differential forces applied by associated string chords 20. Contact between bottom surface 421 and racket surface 415 exists along a movable line of rocking contact at a line of tangency between such surfaces.

Rocker 410 has an upper surface 430 which is concave and extends between ends 422. String receiving slots 435 are formed into ends 422 to receive string 19 therein. The string receiving slots are provided with bearing surfaces 438 which are appropriately curved to minimize bending stress arising from string 19 being arranged over rocker 410 under tension.

Figure 16:
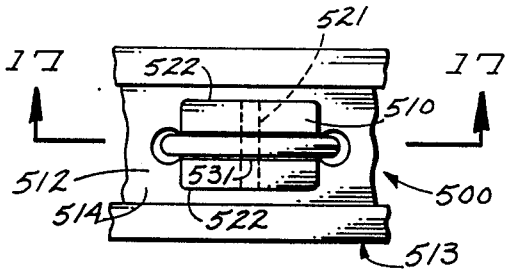
FIG. 16 is a partial plan view similar to FIG. 10 fitted with another alternative rocker.
Figure 17:
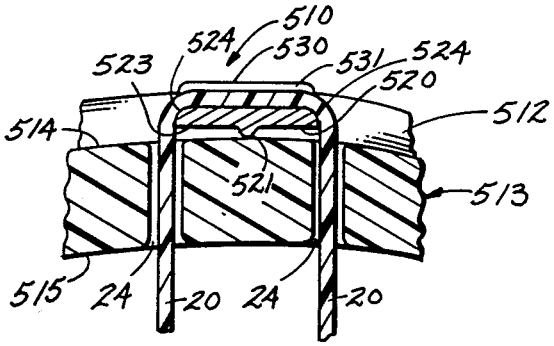
FIG. 17 is a sectional view taken along line 17—17 of FIG. 16.

FIGS. 16 and 17 show another alternative embodiment sports racket tension transmitting device 500 of this invention. Tension transmitting device 500 includes a rocker member 510 which is adapted and mounted for rocking motion in a channel 512 formed in a racket head frame 513. Channel 512 has a bottom surface 514 which faces outwardly. String holes 24 extend between bottom surface 514 and a string opening surface 515.

Rocker member 510 has a bottom surface 520 which is provided with a rocking projection 521. Projection 521 extends transversely across member 510 between sidewalls 522. Projection 521 is tapered toward a fulcrum point which is preferably rounded to minimize hertzian contact stresses in the projection 521 and supporting surface 514. Bottom surface 520 also has substantially flat planar end portions 523 extending outwardly from projection 521 to rocker ends 524. Contact between rocker member 510 and racket surface 514 is along a movable line of rocking contact.

Rocker member 510 also has an upper or top surface 530. Top surface 530 is provided with a string groove 531, which is advantageously flat in a medial region and curved near ends 524.

Figure 18:
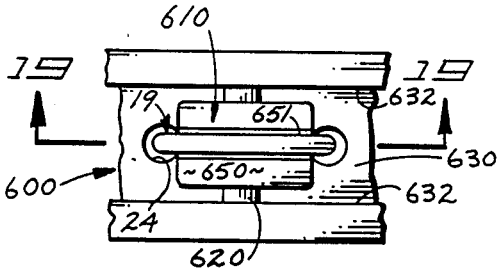
FIG. 18 is a partial plan view similar to FIG. 10 fitted with still another alternative rocker.
Figure 19:
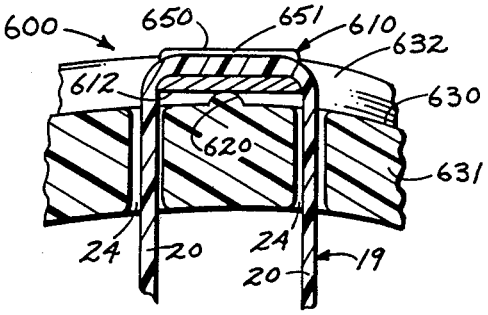
FIG. 19 is a sectional view taken along line 19—19 of FIG. 18.

A still further alternative rocker arrangement 600 according to this invention is shown in FIGS. 18 and 19. Rocker means 600 includes a rocker element 610 which is supported upon a rocking projection 620 formed upon or connected to an outwardly facing surface 630 of a racket head 631. Projection 620 preferably extends across the entire bottom surface 630 between channel walls 632. Projection 620 is preferably convex and may be semicylindrical. The projection may be integral with the racket head or provided as an attachment and glued or otherwise appropriately secured to the racket head between adjacent string holes 24.

It should be understood that the above described embodiments are provided to exemplify the present invention. It should also be understood that other forms, including those having variations or combinations of features shown or even features that are not shown herein may be readily devised from the examples shown. Such variations or combinations that may be realized by a person of ordinary skill in the field of the present invention are intended to fall within the scope of the appended claims.

Rocker element 610 has a flat planar bottom surface 612 which bears upon rocker projection 620. Bottom surface 612 is in rocking relationship with projection 620 along a movable line of contact extending across the bottom face of the rocker element and across projection 620 along a line of mutual tangency. A top surface 650 of rocker member 610 is provided with a string receiving groove 651.

It is preferable that the individual rocker members be formed of a substantially rigid material such as aluminum or other lightweight high strength material. Rigidity in a longitudinal plane extending between the top and bottom surfaces is needed so the rocker elements will rock rather than deform as springs. High strength plastics, such as graphite-filled polyamide may also be used. Other materials which can provide such substantial rigidity and withstand the hertzian contact stresses at the frame may also be used.

The rocker members described above can be used on racket 10 or other appropriate strung sports rackets. The rocker members are installed between the string 19 and the supporting portion of the racket frame.

FIG. 1 indicates that racket 10 is advantageously provided with a number of individual rockers 28. The rockers can be installed at every loop of the string. Alternatively, the tension transmission devices can be regularly or irregularly interspersed with conventional wrap-around mountings or other types of string mountings either currently known or hereafter developed. It has been found preferable for rockers 28 to be used at nearly all available string hole locations about the racket head. Possible exceptions are at areas at the top and bottom "corners" of the racket face where the string chords must form fairly sharp angles with the curvature of the racket head frame. In certain applications it may be preferred to place rockers between the string and head frame surface 21 at every point on the racket head frame where the string would otherwise be pulled tight against the outer head frame surface.

The present rockers may be used especially with particular rackets such as that shown in my issued U.S. Pat. No. 4,591,165 which is hereby incorporated by reference hereinto. Alternatively, the present rockers may be retrofitted to an existing racket frame head between adjacent or associated string segments to provide tension transmitting capability between the associated string chords. The rockers function especially well as described in the example given above in conjunction with a racket having substantially equally spaced oversized string holes or holes redrilled to loosely and coaxially receive the strings. String holes fitted with anti-friction sleeves (not shown) are also clearly possible.

As indicated, the rockers according to this invention can be made of a variety of materials. It has been discovered that by utilizing materials having varying specific gravities for the rockers, the weight balance of the racket on which the rockers are installed can be varied. If a heavier head is desired because of the player's high strength and greater power, then relatively denser materials can be used for the rockers employed at the distal end. Conversely, the rocker weight can be distributed more toward the handle by using denser rockers closer thereto. Lateral variations in balance are also possible. Variations in rocker weight can also be accomplished in other ways as will be obvious to those of skill in the art from this explanation.

Figures 20, 21:
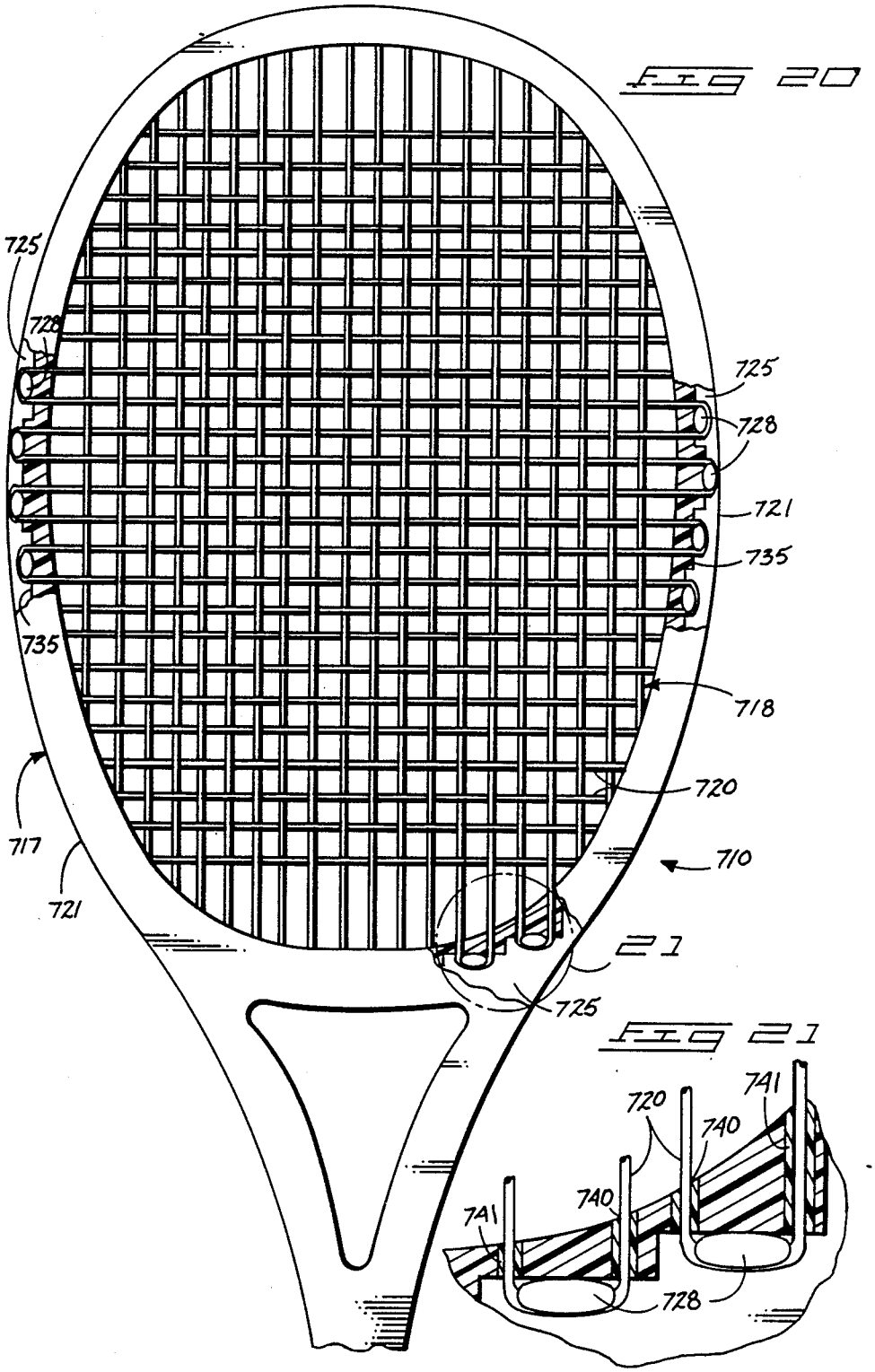
FIG. 20 is a frontal view of an alternative racket of this invention with portions removed and shown in section.
FIG. 21 is an enlarged view of the sectioned portion circled in FIG. 20.

FIG. 20 shows an alternative racket design according to this invention. Racket 710 includes a head frame 717 which is generally similar to head frame 17 described above. A plurality of string segments 720 are arranged across a string opening 718 defined by interior surfaces of the head frame. The head frame includes an outer perimetric surface 721 which includes a recessed annular channel 725. The bottom surface of the head frame channel is provided with a series of lands or flats 735 which are perpendicular to the string chords supported by an adjacent contacting rocker 728. The flats 735 are advantageously separated by steps in the channel bottom surface, or other alternative transition structures. This arrangement is used for all string except at the corners of the racket which employ a conventional wrap-around support. The individual string chords 720 pass through string holes 740 which are advantageously provided with low friction tubular guides 741. The guides are advantageously made from nylon, TEFLON (PTFE) or other low friction plastic material.

It should be noted that stringing of rackets having the present rockers mounted thereto may be accomplished in substantially the usual manner. The exception is that individual rockers will be inserted as stringing progresses. One rocker will be placed between the string and head frame surface at each wrap where the string passes through one hole and extends over the outer surface to be received through the next adjacent hole. Mating parts such as projection 240 and pocket 251 must also be assured during assembly.

The operation of tension transmitting devices according to this invention will now be more fully described. FIG. 3 shows rocker 28 in an equilibrium position associated with equal tensile forces existing in associated string chords 20. The position shown in FIG. 3 is a central or neutral equilibrium position wherein the rocker is free to rock in either direction. FIGS. 5 and 6 show exaggerated displaced rocking positions associated with a difference in the tensile forces existing in the associated chords. In FIG. 5 a greater force exists in the right hand string chord causing a clockwise rocking of rocker 28. In FIG. 6 a greater force exists in the left hand string chord causing a counter clockwise rocking of rocker 28. Rocker 28 rocks in response to such differential forces in a way which transmits force from the more tensile chord to the less tensile chord.

The terms "rocking", "rock" and "rockable", as used herein, are to be interpreted as specifically relating to a form of motion between two elements which are in contact at either a point of contact or along a line of contact with rocking motion between the two elements causing a related movement of the point or line of contact therebetween. Such rocking motion must be distinguished from pivotal motion which occurs between two parts along a pivotal axis which is fixed relative to the two pivotable parts. Examples of pivotable, non-rocking motion include well known pulley rollers and wheels mounted to appropriate frames.

During play, racket 10 is used to hit a ball or other playing object. When the object impacts the string chords, energy is transferred to the strings and racket. Kinetic energy of the ball can be stored in the form of strain energy in the strings as an elongation of strings since the strings are elastic. Rackets equipped with tension transmitting devices of this invention cause tension in the impacting string chords to be transferred to other or all additional string chords in the racket. This provides greater efficiency of energy storage and allows more of the kinetic energy of the ball to be stored in the racket during impact. Energy is stored in string chords which are not in contact with the ball. The stored or strain energy developed during impact is also efficiently reconverted back to kinetic energy of the ball upon rebound using the tension transmitting devices. The devices transfer force and energy from non-contacting chords to associated string chords and finally to chords which are in actual contact with the ball.

The invention also reduces peak dynamic tension in the strings because the kinetic energy of the ball is transferred into stored strain energy using a much larger number of string chords having a longer length and energy storage ability. The reduction in peak dynamic tension can also be understood in the context of each rocker transmitting part of the peak force to its adjacent string chord thus reducing peak tension in the contacted or impacted chords but increasing tension in the associated non-contacting chords.

The reduced peak dynamic tension and increase in overall strain and stored strain energy have several beneficial effects. The string is less likely to break. The racket can be strung at a high static tension without concern that a string will break during impact. Since peak dynamic tension is lower, the forces causing wear at the string intersections (each crossover in the weave pattern) are less and wear is decreased. The increased overall distribution and amount of strain allows greater deflection of the string surface at the location of impact. The greater deflection provides a smaller restoring angle on hits near the frame, an effect similar to having a very large racket. This greater deflection of the string surface also results in increased dwell time (the time the ball spends in contact with the strings), thus providing better directional control. The increased dwell time and associated deeper string face deflection also results in better energy transfer and higher ball rebound velocities. In addition, the invention allows more energy to be stored more rapidly in the ball/string system thus reducing the energy which must be dissipated through the racket to the player in the form of shock to the hand, wrist, arm, and elbow.

The tension of all string chords on the racket face remain more nearly uniform even during a hit because the tension from one string chord is distributed by the rockers to the remaining string chords. The ball thus sees a more balanced surface when hit off center of the racket face, where the string chords have substantially differing lengths. Further, since the change in tension is less, the difference in control between hard and softer hits will be less, giving the player a wider range of available hits.

There is a feeling among many players that play is better with natural gut strings than with synthetic strings. It is believed that this is due in part to the fact that gut has a lower modulus of elasticity at strung tensions, thus giving greater resiliency or elasticity during play. The present invention may achieve a similar effect using synthetic strings. The synthetic strings are desirable because they play more consistently through changes in weather conditions. The life of either type of string is increased by the invention because of the reduced peak tension.

A very important advantage of the present invention over pulley systems or saddle string mounts is the basic simplicity of the present rocker structure. The present invention also allows the head weight of the racket to be maintained at a desirable value. Prior art spring, pulley and other tension reducing apparatus significantly increased the head weight and adversely affected racket balance and performance.

Another advantage of the current invention is that there is no interference by the rockers or intrusion of mechanisms into the string opening 18. This is important since anything extending into the opening 18 will effectively diminish the opening size and decrease the effective string length. Further, the tension rockers require little if any maintenance and likelihood of malfunction is remote.

In compliance with the statute, the invention has been described in language more or less specific as to structural features. It is again emphasized that the invention is not limited to the specific features shown, since the means and construction herein disclosed comprise preferred forms of putting the invention into effect. The invention is, therefore, claimed in any of its forms or modifications within the proper scope of the appended claims, appropriately interpreted in accordance with the doctrine of equivalents.

We claim:

1. A sports racket comprising:

a handle;

a racket head frame connected to the handle, the head frame being formed about a substantially planer string opening;

at least one rocker support surface on the head frame;

a plurality of string holes formed through the head frame from the rocker support surface into the string opening;

an elongated rigid rocker member having a longitudinal top side and a longitudinal bottom side opposed from said top side, each extending between opposing longitudinal ends on the rocker member; said rocker member being elongated to provide a length between the opposing longitudinal ends which is greater than a maximum thickness separating said top side and said bottom side;

string receiving means on the rocker member longitudinally engaging a racket string therein and positioning an engaged racket string over said opposing longitudinal ends of the rocker member in a pair of associated string chord sections; and rocker means operably interposed between the rocker member and the rocker support surface for supporting the rocker member in a rockable relationship against the rocker support surface of the racket head and for transmitting tension between associated string chord sections of a racket string engaged by the rocker member by rocking action of the rocker member relative to the rocker support surface along a movable line of contact extending transversely across the bottom side of the rocker member.

2. The sports racket of claim 1 wherein the rocker means includes a curved rocking surface on the bottom side of the rocker member.

3. The sports racket of claim 1 wherein the rocker means includes a convexly curved rocking surface on the bottom side of the rocker member.

4. The sports racket of claim 3 wherein the convexly curved rocking surface extends along the bottom side of the rocker member between opposing ends of the rocker.

5. The sports racket of claim 4 wherein the convexly curved rocking surface has an approximate radius of curvature which is a minimum of approximately three times a length distance of the rocker member defined between opposing ends of the rocker member.

6. The sports racket of claim 3 wherein the convexly curved rocking surface extends over only a portion of the bottom side of the rocker member.

7. The sports racket of claim 3 wherein the rocker means further includes an outwardly facing head frame surface.

8. The sports racket of claim 3 wherein the convexly curved rocking surface is semicylindrical about a curvature axis which is approximately perpendicular to a longitudinal plane extending through the rocker member between opposing ends thereof.

9. The sports racket of claim 1 wherein the rocker means includes a flat bottom surface on the rocker member and a projection formed on the rocker support surface.

10. The sports racket of claim 9 wherein said projection is convex upon distal portions thereof.

11. The sports racket of claim 1 wherein the rocker means includes a concavely curved rocking surface on the bottom side of the rocker member.

12. The sports racket of claim 1 wherein the rocker means includes a concavely curved rocking surface on the bottom side of the rocker member, and a projection formed on the rocker support surface and adapted to extend within the concavely curved rocking surface in rockable relationship thereto.

13. The sports racket of claim 12 wherein said projection formed on the rocker support surface is rounded having a convex curvature which is more sharply curved than the concavely curved rocking surface on the bottom side of the rocker member.

14. The sports racket of claim 12 wherein said concavely curved rocking surface is approximately semi-spherical, and said projection has distal portions which are approximately semi-spherical, thus providing approximately point contact therebetween.

15. The sports racket of claim 1 wherein the length of the rocker member is more than twice the maximum thickness.

16. The sports racket of claim 1 wherein the string receiving means includes an arcuate groove formed into the top side of the rocker member to receive and support a string and to minimize localized stress along the string received thereby.

17. The sports racket of claim 1 wherein the rocker member is totally formed of a rigid material.

18. The sports racket of claim 8 wherein the top surface includes a string receiving groove formed over at least a portion of the top surface.

19. The sports racket of claim 18 wherein the string receiving groove is formed approximately along a longitudinal plane and the rocking surface is substantially cylindrical about a curvature axis oriented substantially perpendicular to the longitudinal plane.

20. The sports racket of claim 8 wherein the string receiving means is a longitudinally arcuate groove in the rocker member at a depth adapted to receive a racket string in a fully recessed position with the rocker member top side projecting beyond a string received therein.

21. The sports racket of claim 1 wherein the rocker body includes spaced sidewalls at least one of which is convex.

22. The sports racket of claim 1 wherein the rocker means is a convexly curved surface extending substantially between opposing ends of the rocker member; and wherein the string receiving means is an arcuate groove formed in the top surface of the rocker member.

23. The sports racket of claim 22 wherein the rocker member includes a length dimension between ends of approximately 11 millimeters, and a rocker surface formed on a radius of approximately 35 millimeters.

24. A sports racket comprising:

at least one handle;

a head frame connected to the handle; said head frame having at least one rocker support surface formed thereon, and a plurality of string holes extending between the rocker support surface and a string opening within at least portions of the head frame;

a plurality of string tension transmitting devices for supporting at least one racket string, each string tension transmitting device comprising:

a rocker member having a longitudinal rocking surface and a longitudinal string support surface, said rocking surface and said string support surface lying along opposing sides of the rocker member, said rocker member being elongated between opposing longitudinal ends to provide a length thereof which is greater than a maximum thickness defined between said rocking surface and said string support surface at a maximum point of spacing between said rocking surface and said string support surface;

string receiving means on the rocker member; said string receiving means being adapted to longitudinally position a racket string over the string support surface and over the opposing ends of the rocker member in a pair of associated string chords;

rocker means for supporting the rocker member against the racket head frame in a rockable relationship thereto along a movable line of contact extending transversely across the rocking surface of the rocker member to allow the rocker member to transmit tension between associated string chords which are connected by a racket string trained over and supported by the string receiving means on the rocker member;

said elongated rocker member and said rocker means being constructed to provide outwardly directed axial motion of a string chord supported at one of said opposing longitudinal ends of the elongated rocker in response to inwardly directed axial motion of another associated string chord supported at the opposite longitudinal end of said rocker member.

25. A sports racket according to claim 24 wherein at least one of said rocking surfaces of the tension transmitting devices is convexly curved over at least portions thereof.

26. A sports racket according to claim 24 wherein at least one of said rocking surfaces of the tension transmitting devices is concavely curved over at least portions thereof.

27. A sports racket according to claim 24 wherein at least one of said rocking surfaces of the tension transmitting devices is flat and wherein the rocker means also includes a convex projection of the rocker support surface for engaging the flat rocking surface in rockable relationship thereto.

28. A sports racket according to claim 24 wherein the racket head frame is provided with a channel with recessed bottom portions of said channel forming said at least one rocker support surface.

29. A sports racket according to claim 24 wherein the racket head frame is provided with a channel with recessed bottom portions of said channel forming said at least one rocker support surface; and said rocking surfaces of the tension transmitting devices are convexly curved to rock within said channel.

30. A sports racket according to claim 29 wherein the rocker members are arranged with said longitudinal planes thereof approximately aligned with said channel and said string openings to produce an approximately planar string surface.

31. A sports racket according to claim 30 wherein at least one of the string receiving means is an arcuate groove formed in at least one of the rocker members.

32. A sports racket according to claim 31 wherein said arcuate groove is curved using relatively sharper curvature near said opposing ends and using a relatively flatter curvature at a medial portion intermediate to said opposing ends.

33. A string tension transmitting device for use in a sports racket having a racket head frame which supports at least one racket string strung across a string opening of the head frame to form a plurality of string chords; the tension transmitting device comprising:

an elongated rigid rocker member having a longitudinally curved convex rocking surface and a longitudinal string support surface, said rocking surface and said string support surface lying along opposing sides of the rocker member, said rocker member being elongated between opposing longitudinal ends to provide a length thereof which is greater than a maximum thickness defined between said rocking surface and said string support surface at a maximum point of spacing between said rocking surface and said string support surface;

string receiving means on the rocker member for longitudinally positioning a racket string over the string support surface and over the opposing longitudinal ends of the rocker member in a pair of associated string chords;

rocker means for supporting the rocker member against the racket head frame in a rockable relationship thereto along a movable line of contact extending transversely across the rocking surface of the rocker member to allow the rocker member to transmit tension between associated string chords which are connected by a racket string trained over and supported by the string receiving means on the rocker member;

said elongated rocker member and said rocker means being constructed to provide outwardly directed axial motion of a string chord supported at one of said opposing longitudinal ends of the elongated rocker in response to inwardly directed axial motion of another associated string chord supported at the opposite longitudinal end of said rocker member.

34. A string tension transmitting device according to claim 33 wherein the string receiving means is an arcuate groove formed in the rocker member for receiving a racket string therethrough.

35. A string tension transmitting device according to claim 33 wherein the maximum thickness of the rocker member is less than one half the length between said opposing ends.

36. A string tension transmitting device for use in a racket having a racket head frame formed about a substantially planer string opening, at least one rocker support surface on the head frame, and a plurality of string holes formed through the head frame from the rocker support surface into the string opening, the tension transmitting device comprising:

an elongated rigid rocker member having a longitudinal top side an a longitudinal bottom side opposed from said top side, each extending between opposing longitudinal ends on the rocker member, said rocker member being elongated to provide a length between the opposing longitudinal ends which is greater than a maximum thickness separating the top side and the bottom side thereof;

string receiving means on the rocker member for longitudinally engaging a racket string therein and positioning an engaged racket string over said opposing longitudinal ends of the rocker member in a pair of associated string sections; and rocker means adapted to be interposed between the rocker member and the rocker support surface for supporting the rocker member in a rockable relationship against the rocker support surface of the racket head and for transmitting tension between associated string chord sections of a racket string engaged by the rocker member by rocking action of the rocker member relative to the rocker support surface along the movable line of contact extending transversely across the bottom side of the rocker member;

wherein the rocker means includes a longitudinally curved convex rocking surface on the bottom side of the rocker member.

37. The string tension transmitting device of claim 36 wherein the longitudinally curved convex rocking surface extends along the bottom side of the rocker member between its opposing longitudinal ends.

38. The string tension transmitting device of claim 36 wherein the longitudinally curved convex rocking surface has an approximate radius of curvature which is a minimum of three times the length of the rocker member.

39. The string tension transmitting device of claim 36 wherein the longitudinally curved convex rocking surface extends over only a portion of the bottom side of the rocker member.

40. The string tension transmitting device of claim 36 wherein the longitudinally curved convex rocking surface is semicylindrical about a longitudinal axis which is approximately perpendicular to a longitudinal plane extending through the rocker member between its opposing longitudinal ends.

41. The string tension transmitting device of claim 36 wherein the string receiving means comprises a longitudinal groove formed over at least a portion of the top surface of the rocker member.

42. The string tension transmitting device of claim 41 wherein the groove is formed along a longitudinal plane and the rocking surface is substantially cylindrical about an axis perpendicular to the longitudinal plane.

43. The string tension transmitting device of claim 36 wherein the string receiving means is a longitudinally arcuate groove in the top side of the rocker member, the groove having a depth adapted to receive a racket string in a fully recessed position with the rocker member top side projecting beyond a string received therein.

44. The string tension transmitting device of claim 36 wherein the rocker member includes spaced side walls which are convex.

* * * * *